United States Patent [19]

Gregory

[11] Patent Number: 4,549,558

[45] Date of Patent: Oct. 29, 1985

[54] SMOKING APPLIANCE

[76] Inventor: Samuel T. Gregory, Rich Square Rd., Scotland Neck, N.C. 27874

[21] Appl. No.: 637,963

[22] Filed: Aug. 6, 1984

[51] Int. Cl.[4] ..... A24D 1/04

[52] U.S. Cl. ..... 131/202; 131/227

[58] Field of Search ..... 131/202, 227

[56] References Cited

U.S. PATENT DOCUMENTS

| | | | |
|---|---|---|---|
| 1,468,318 | 9/1923 | McMillan | 131/202 |
| 1,661,895 | 3/1928 | Hilshansky | 131/227 |
| 2,205,553 | 6/1940 | Blair | 131/227 |

*Primary Examiner*—V. Millin
*Assistant Examiner*—Greg Beaucage
*Attorney, Agent, or Firm*—Mills and Coats

[57] ABSTRACT

This invention is an improved smoking appliance in the form of a pipe having a filter holder which is readily openable for insertion and removal of the filter and yet is compact when in the closed position. Also an improved filter medium is provided for entrapping high percentage of tar and nicotine thus greatly reducing the amount of the substances which are drawn into the body of the smoker. This filter medium is chemically treated to further reduce the bite normally associated with smoking and particularly pipe smoking.

9 Claims, 2 Drawing Figures

SMOKING APPLIANCE

FIELD OF INVENTION

This invention relates to smoking appliances and more particularly to smoking pipes and the filters associated therewith.

BACKGROUND OF INVENTION

Since man first began to use tobacco in smoke form, filtration of the same in order to reduce the pungent tars emitted therefrom as well as the tongue biting nicotine have been experimeted with. Filters have been used in conjunction with cigar and cigarette holders, have been built into the cigarettes themselves, and, of course, have been employed in pipe type smoking appliances.

Although the present invention obviously could be employed in cigar and cigarette type holders, reference herein will be made primarily to pipe type smoking apparatus.

Originally pipes were formed from clay and other materials with unimpeded bores through the stems thereof. To reduce the tar and nicotine build-up in the stems as well as the amount of such substances which was ingested by the smoker, various configured traps have been placed in the pipe stems so that the surfaces thereof could collect a portion of the tar and nicotine. Further, filters in the form of round tubular members for entrapment of nicotine and tar are commercially available under the brand name "Dr. Grabow" as well as others which fit specially designed pipes. Even the use of tobacco as a filter medium has been experimented with as has the use of entire filter type cigarettes as the filter medium.

Because of the peculiar configuration of smoking pipes, cigarette type filters alone are unsuitable because there is a great deal more tar and nicotine in the average pipe bowl of tobacco than in a single cigarette (which is what cigarette filters are, of course, designed for). Additionally, pipe smokers invariably reload their pipes and smoke several bowls before even considering changing the filter. When the pipe filter is finally changed, it is usually a major task since invariably the only reason it is done is that the filter and the entire stem has accumulated so much tar and nicotine that the pipe has become "too strong to smoke". When the pipe smoker is out in public, he does not usually want to expose other people to the messy, foul smelling pipe cleaners, the overloaded pipe filters and associated cleaning paraphernalia. Thus the average pipe smoker will often smoke his pipe well past the time when it should be cleaned and the filter changed.

BRIEF DESCRIPTION OF INVENTION

After much research and study into the above-mentioned problems, the present invention has been developed to provide not only a superior filter means for pipe type smoking apparatus but also a means for readily changing the same without soiling the hands or creating the normal "mess" associated with pipe cleaning and filter changing.

The above is accomplished through the use of a trough-like semi-cylindrical filter support with a hinged semi-cylindrical cover.

An improved filter medium is also provided which includes either a double or single filter wrapped in a paper cartridge with at least one part of such filter being formed from processed paper or similar material loosely rolled and impregnated with an alkaline material to effectively neutralize the "bite" associated with pipe smoking.

In view of the above it is an object of the present invention to provide a semi-cylindrical support means for smoking appliance filters.

Another object of the present invention is to provide a hinged, semi-cylindrical cover for a smoking appliance filter which is pivotable for replacement of the filter and removable for cleaning.

Another object of the present invention is to provide an improved filter for smoking appliances including an absorbent, relatively loosely rolled paper filter material which is pretreated with an alkaline substance to trap large quantities of tar and nicotine and to neutralize the acidic bite of the smoke.

Another object of the present invention is to provide a two-section filter, at least one of which includes a paper cylinder having a loosely rolled cellulose fiber material therein.

Another object of the present invention is to provide a fibrous filter for a smoking appliances which is alkaline treated to reduce the acidic bite of smoke as it is drawn into the mouth of the user thereof.

Other objects and advantages of the present invention will become apparent and obvious from a study of the following description and the accompanying drawings which are merely illustrative of such invention.

DETAILED DESCRIPTION OF INVENTION

Figure 1:
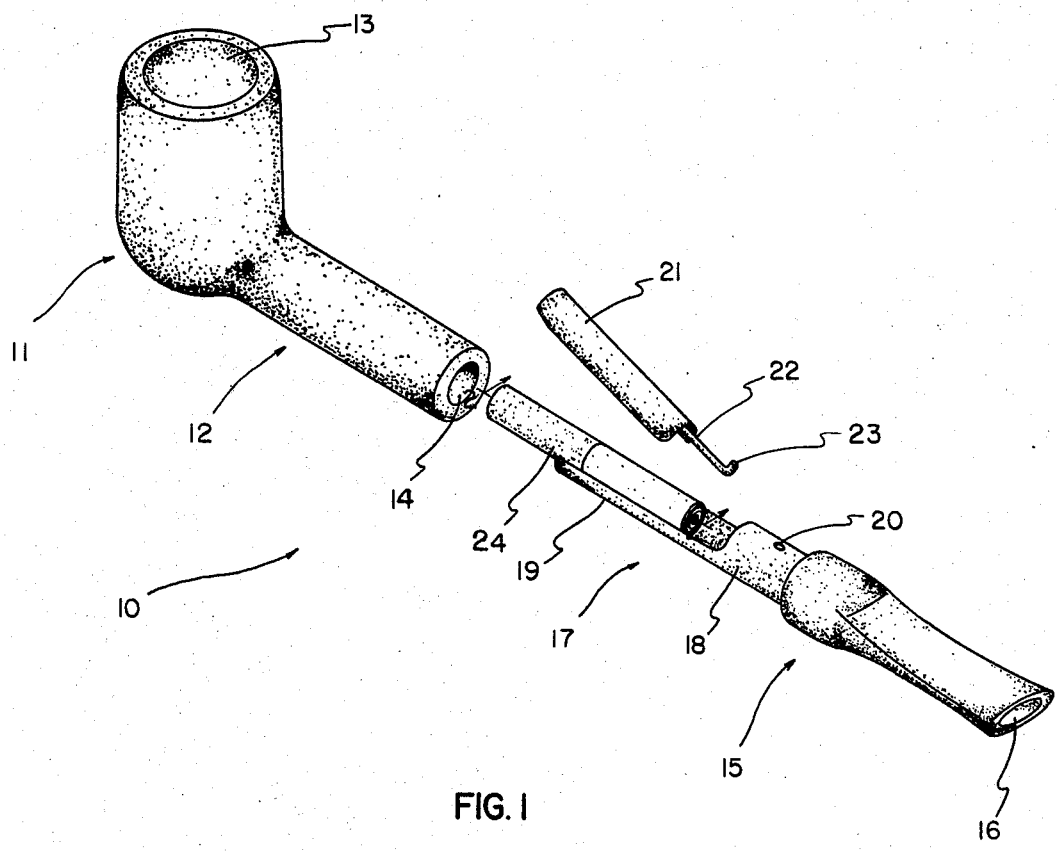
FIG. 1 is an exploded perspective view of the improved smoking appliance of the present invention.
Figure 2:
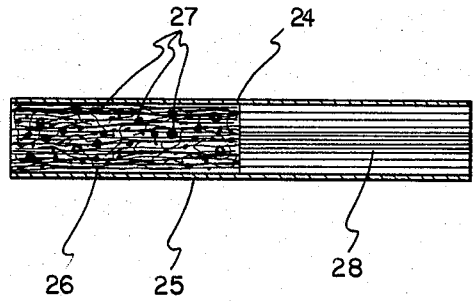
FIG. 2 is a sectional view taken through lines 2—2 of FIG. 1.

With further reference to the drawings, a smoking appliance, indicated generally at 10, includes a bowl portion, indicated generally at 11 and a stem portion, indicated generally at 12. The interior 13 of bowl portion 11 communicates with passageway 14 passing longitudinally through stem 12.

A mouthpiece portion, indicated generally at 15, is provided with a passageway 16 passing longitudinally therethrough.

To the end of mouthpiece 15 opposite passageway 16 is a filter portion, indicated generally at 17, which is cylindrical, as indicated at 18, where it joins mouthpiece 15 but is semicylindrical, as indicated at 19, on its outermost end. A small opening 20 is provided in the upper portion of cylinder 18.

A semi-cylindrical shaped closure 21 is provided which is adapted to lie adjacent semi-cylindrical area 19 of filter portion 17. A hinge arm 22 is fixedly secured to closure 21 at one end and includes a hook 23 at the other end. This hook is adapted to engage opening 20 of cylinder area 18. Due to the curvature of hook 23, closure 21 can be lifted up or opened approximately 20 degrees relative to semi-cylindrical area 19 without the hook 23 disengaging the opening 20 thus providing more than an adequate access for removal of filter 24.

The filter indicated at 24 is in the form of a paper cylinder 25 having processed paper 26 rolled in one end thereof. This processed paper filter medium is impregnated with an alkaline substance 27 which, as the smoke passes through such filter medium, the acidic tars and nicotine will be neutralized thus effectively eliminating the bite normally associated with tobacco smoke and particularly pipe tobacco smoke.

The soft filter medium 26 is preferably made from a highly absorbent material having the consistency of a good grade paper towel. Since fibrous material of this type is commercially available, further detailed discussion of the same is not deemed necessary.

Relative to the alkaline treatment, the soft filter medium 26 is soaked in a strong chemical solution having the chemical composition of antiacid tablets (such as Dihydroxyaluminum Sodium Carbonate) dissolved in water. Once the filter medium has been so treated and redried, the natural moisture in the smoke passing through the filter medium will activate the alkaline material and neutralize the acidic ph in such smoke. Since antiacid type alkaline chemicals are well known to those skilled in the art, further detailed discussion of the same is not deemed necessary.

If desired a dual or two-piece filter can be used, one part containing the soft fibrous material 26 referred to above and the other portion containing a filter medium 28 of the type found in the filters of filter cigarettes. Since filter mediums of this type are well known to those skilled in the art, further detailed discussion of this portion of this invention is not deemed necessary.

The inside diameter of the filter portion 17 is approximately 5/16th inch so that such filter portion can accept a regular filter cigarette as a substitute for the above described filter should the same not be readily available.

To use the improved smoking appliance of the present invention, the hook 23 of hinge arm 22 of semi-cylindrical closure 21 is inserted into opening 20 of cylindrical area 18. The outer end of closure 21 is lifted to expose semi-cylindrical area 19 where filter 21 is laid and, if desired, pushed at least partially into cylinder 18. The closure 21 is then hingedly pivoted juxtaposed to filter 21 thus forming a cylindrical configuration between semi-cylindrical area 19 and semi-cylindrical closure 21. This cylindrical configuration with the filter 21 interiorly thereof is inserted into longitudinal passageway 14 of stem 12 until the end of mouthpiece 15 lies juxtaposed to stem 12 thus completely enclosing the filter portion 17. The smoking appliance 10 is now ready for the interior 13 of bowl 11 to be filled with tobacco and lit with the smoke therefrom being drawn through filter 24 and out passageway 16 into the mouth of the smoker thereof.

Whenever it is desired to remove the filter 24, the mouthpiece 15 and its associated filter portion 17 is pulled out of stem 12 and closure 21 is lifted with hook 23 pivoting in opening 20. The filter 24 can then be simply lifted out of semi-cylindrical area 19 or such area can be turned down and the filter allowed to simply fall therefrom thus eliminating all handling of such filter. A new filter can be inserted as described above and closure 21 pressed down thereagainst. The filter portion 17 can then be reinserted into stem 12 and the smoking appliance lit as earlier set forth.

From the above it can be seen that the present invention provides a greatly improved smoking appliance which not only entraps large amounts of tar, nicotine and moisture during the smoking process but also neutralizes the acidic smoke thus effectively eliminating the bite thereof. To insert the filter, it is simply laid into the semi-cylindrical area and the semi-cylindrical closure pressed down against such filter as it is inserted into the stem of the bowl portion. Likewise, to remove such filter after use, the filter portion is pulled from the stem, the semi-cylindrical closure opened, and the dirty filter allowed to fall from the semi-cylindrical area 19 thus eliminating the necessity of handling the soiled filter thereby making use of the same much more attractive to the smoker and giving more incentive to change the filter at regular intervals rather than waiting for excessive build-up of tar and nicotine to occur therein.

The present invention can, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An improved smoking appliance comprising: an elongated stem means having a longitudinal opening therein operatively communicating with a smoking material holding means; an elongated mouthpiece means having a longitudinal opening therein passing therethrough; a generally semi-cylindrical filter support means secured to and outwardly extending from one end of said mouthpiece means; and a generally semi-cylindrical closure means mounted adjacent said semi-cylindrical filter support means to form a generally cylindrical configuration therebetween whereby when a filter means is placed in said semi-cylindrical support means and said semi-cylindrical closure means is placed thereover, the thus formed cylindrical configuration can be placed in said longitudinal opening in said stem to form an improved smoking appliance.

2. The improved smoking appliance of claim 1 wherein said semi-cylindrical closure means is pivotably mounted relative to said semi-cylindrical support means.

3. The improved smoking appliance of claim 2 wherein said pivotably mounted, semi-cylindrical closure includes a hinge arm fixedly secured thereto at one end and having a hook at the other end to engage an opening in said mouthpiece.

4. The improved smoking appliance of claim 2 wherein said semi-cylindrical closure is hingedly pivotable to an angle of approximately 20 degrees from said semi-cylindrical filter support means.

5. The improved smoking appliance of claim 2 wherein said pivotable closure is removable for cleaning.

6. The improved smoking appliance of claim 1 wherein said filter is generally cylindrical shaped and includes a highly absorbent, rolled filter medium therein.

7. The improved smoking appliance of claim 6 wherein said highly absorbent filter medium is approximately equal to a quality paper towel.

8. The improved smoking appliance of claim 7 wherein said filter medium is impreganted with an acid neutralizing chemical.

9. The improved smoking appliance of claim 8 wherein said acid neutralizing chemical is Dihydroxyaluminum Sodium Carbonate.

* * * * *